US012781654B2

(12) United States Patent
Makino

(10) Patent No.: US 12,781,654 B2
(45) Date of Patent: Nov. 3, 2026

(54) HONEYCOMB STRUCTURE

(71) Applicant: NGK INSULATORS, LTD., Nagoya-City (JP)

(72) Inventor: Tetsuya Makino, Nagoya (JP)

(73) Assignee: NGK INSULATORS, LTD., Nagoya-City (JP)

( * ) Notice: Subject to any disclaimer, the term of this patent is extended or adjusted under 35 U.S.C. 154(b) by 65 days.

(21) Appl. No.: 18/923,881

(22) Filed: Oct. 23, 2024

(65) Prior Publication Data

US 2025/0230760 A1 Jul. 17, 2025
US 2026/0104001 A9 Apr. 16, 2026

(30) Foreign Application Priority Data

Jan. 15, 2024 (JP) ..... 2024-003755

(51) Int. Cl.
*B01D 46/24* (2006.01)
*F01N 3/022* (2006.01)

(52) U.S. Cl.
CPC ..... *F01N 3/0222* (2013.01); *F01N 2330/30* (2013.01)

(58) Field of Classification Search
None
See application file for complete search history.

(56) References Cited

U.S. PATENT DOCUMENTS

2020/0003094 A1* 1/2020 Kayama ..... F01N 3/2828
2020/0101442 A1* 4/2020 Kayama ..... B01D 46/24492

FOREIGN PATENT DOCUMENTS

JP 2020-054985 A 4/2020

* cited by examiner

*Primary Examiner* — Mary I Omori
(74) *Attorney, Agent, or Firm* — Muncy, Geissler, Olds & Lowe, P.C.

(57) ABSTRACT

A honeycomb structure body having a partition wall surrounding cells which serve as fluid through channels extending from a first end face to a second end face, wherein the partition wall is a porous body having pores that communicate adjacent cells separated by the partition wall are formed, a ratio (L/T) of a through channel length L (μm) of the pore in the thickness direction of the partition wall to a thickness T (μm) of the partition wall is defined as a bending degree A, the partition wall constituting the honeycomb structure body has an average bending degree $A_{Ave}$, which is an average value of the bending degree A, of 1.10 to 1.40, and a value X ($X=A_{Ave}/B^2$) obtained by dividing the average bending degree $A_{Ave}$ by the square of a deviation bending degree B, which is a deviation of the bending degree A, is 100 to 300.

6 Claims, 4 Drawing Sheets

HONEYCOMB STRUCTURE

The present application is an application based on JP 2024-003755 filed on Jan. 15, 2024 with Japan Patent Office, the entire contents of which are incorporated herein by reference.

BACKGROUND OF THE INVENTION

Field of the Invention

The present invention relates to a honeycomb structure. More specifically, the present invention relates to a honeycomb structure capable of suppressing an increase in pressure loss during deposition of PM such as soot when used as a filter for purifying exhaust gas.

Description of the Related Art

Conventionally, a honeycomb filter using a honeycomb structure has been known as a filter for trapping particulate matter in exhaust gas emitted from an internal combustion engine such as an automobile engine or a device for purifying toxic gas components such as CO, HC, and NOx. The honeycomb structure has a partition wall made of porous ceramics such as cordierite, and a plurality of cells are defined by the partition wall. A honeycomb filter includes such a honeycomb structure provided with plugging portions so as to plug the open ends at the inflow end face side and the outflow end face side of the plurality of cells alternately. In other words, the honeycomb filter has a structure in which inflow cells having the inflow end face side open and the outflow end face side plugged and outflow cells having the inflow end face side plugged and the outflow end face side open are arranged alternately with the partition wall therebetween. In the honeycomb filter, the porous partition wall serves as a filter for trapping particulate matter in exhaust gas. Hereinafter, the particulate matter contained in exhaust gas may be referred to as "PM". The "PM" is an abbreviation for "Particulate Matter."

Due to the strengthening of exhaust gas regulations, a honeycomb filter using the honeycomb structure is required to have improved trapping performance of trapping PM while also having low pressure loss, and various studies have been conducted on this issue (for example, refer to Patent Document 1).

[Patent Document 1] JP-A-2020-54985

For example, as a means for reducing pressure loss of the honeycomb filter, a method of increasing porosity of the porous partition wall constituting the honeycomb structure can be cited. However, if the porosity of the partition wall is simply increased, the trapping performance as a filter is deteriorated. As described above, it has been conventionally believed that increasing the porosity of the honeycomb filter to reduce pressure loss and improving the trapping performance of trapping PM are in an antinomic relationship, and it has been extremely difficult to solve both at the same time. Therefore, it is desired to develop a honeycomb structure for a honeycomb filter capable of effectively suppressing an increase in pressure loss during deposition of PM such as soot while maintaining the porosity of the partition wall.

The present invention has been made in view of the problems with the prior arts described above. According to the present invention, there is provided a honeycomb structure capable of suppressing an increase in pressure loss during deposition of PM such as soot when used as a filter for purifying exhaust gas.

SUMMARY OF THE INVENTION

According to the present invention, a honeycomb structure described below is provided.

[1] A honeycomb structure including a pillar-shaped honeycomb structure body having a partition wall arranged so as to surround a plurality of cells which serve as fluid through channels extending from a first end face to a second end face, wherein the partition wall is formed by a porous body in which a plurality of pores that communicate adjacent cells separated by the partition wall are formed, a ratio (LIT) of a through channel length L (μm) of the pore in the thickness direction of the partition wall to a thickness T (km) of the partition wall is defined as a bending degree A, the partition wall constituting the honeycomb structure body has an average bending degree $A_{Ave}$, which is an average value of the bending degree A, of 1.10 to 1.40, and a value X ($X=A_{Ave}/B^2$) obtained by dividing the average bending degree $A_{Ave}$ by the square of a deviation bending degree B, which is a deviation of the bending degree A, is 100 to 300.

[2] The honeycomb structure according to [1], further including a plugging portion disposed at an open end on the first end face side or the second end face side of each of the cells.

[3] The honeycomb structure according to [1] or [2], wherein a thickness T1 of the partition wall is 100 to 300 μm.

[4] The honeycomb structure according to any one of [1] to [3], wherein a porosity of the partition wall is 35 to 70%.

[5] The honeycomb structure according to any one of [1] to [4], wherein an average pore diameter of the partition wall is 8 to 30 μm.

[6] The honeycomb structure according to any one of [1] to [5], wherein the X is 150 to 300.

The honeycomb structure of the present invention can suppress an increase in pressure loss during deposition of PM such as soot when used as a filter for purifying exhaust gas. In particular, the honeycomb structure of the present invention has a remarkable advantage in that an increase in pressure loss during deposition of PM can be suppressed while maintaining the porosity of the partition wall, that is, without requiring a special technique such as increasing porosity of the partition wall.

DESCRIPTION OF THE PREFERRED EMBODIMENTS

The following will describe embodiments of the present invention; however, the present invention is not limited to the following embodiments. Therefore, it should be understood that those created by adding changes, improvements or the like to the following embodiments, as appropriate, on the basis of the common knowledge of a person skilled in the art without departing from the spirit of the present invention are also covered by the scope of the present invention.

Figure 1:
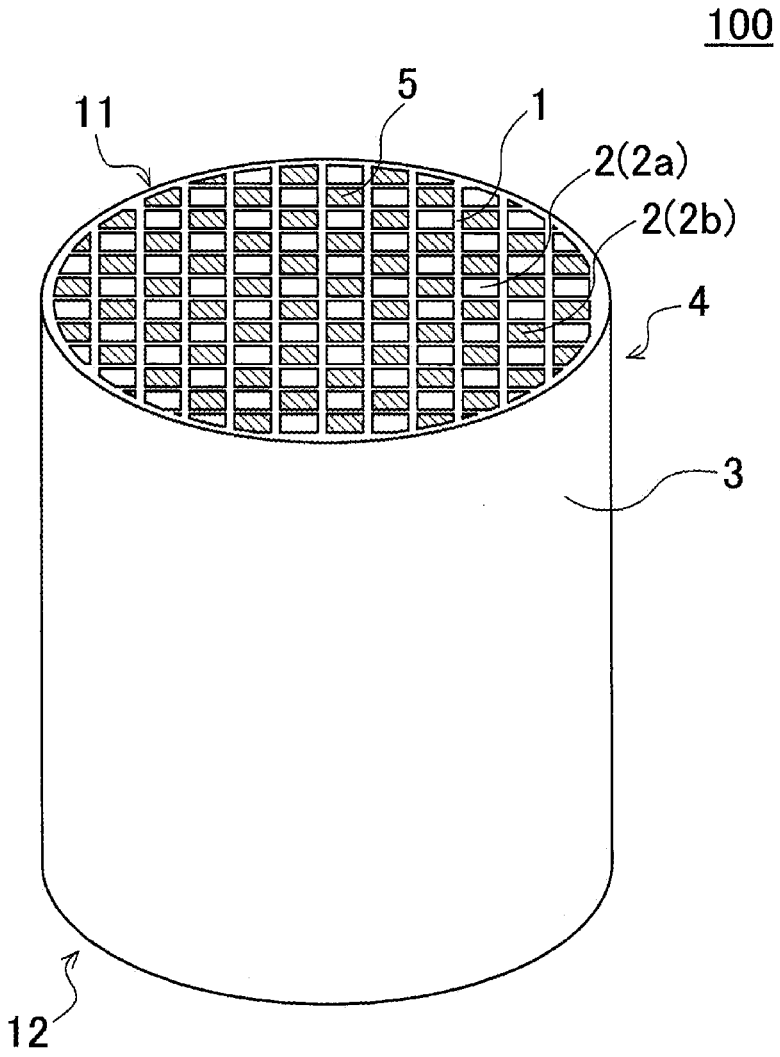
FIG. 1 is a perspective view schematically showing one embodiment of the honeycomb structure of the present invention.
Figure 2:
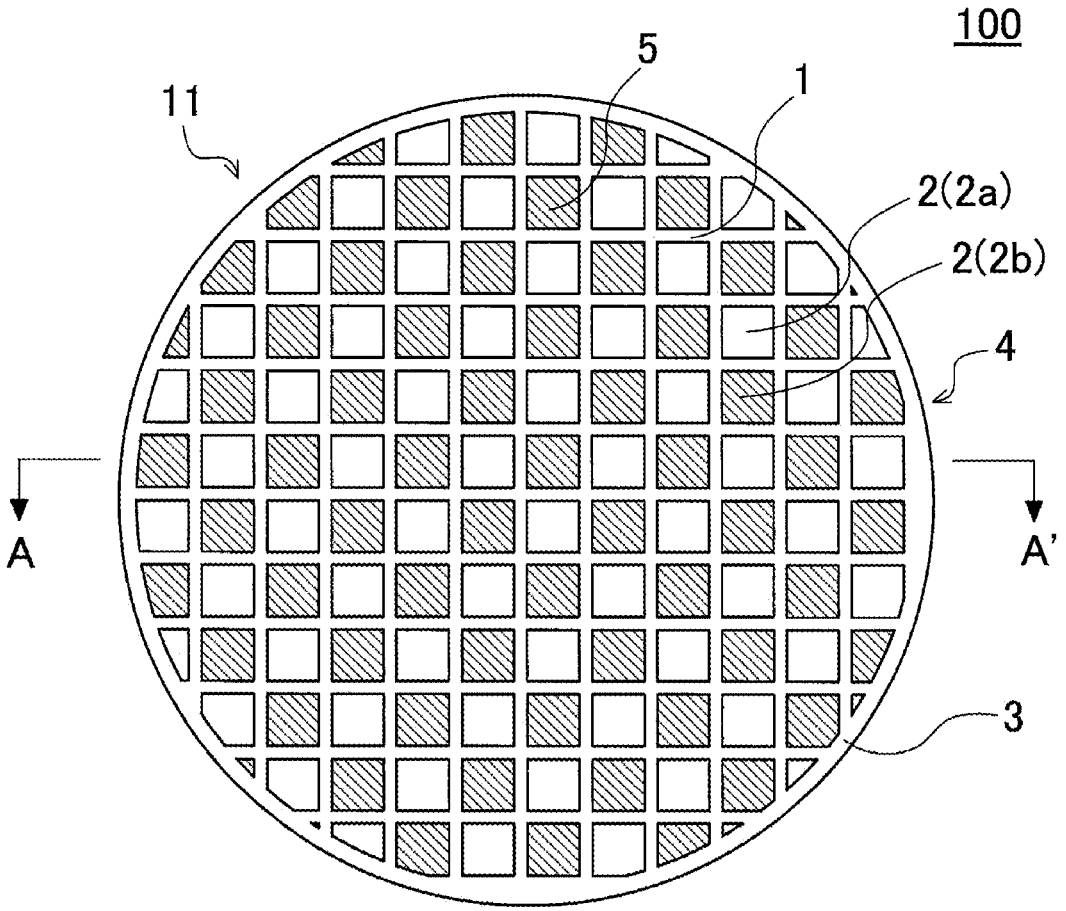
FIG. 2 is a plan view of the honeycomb structure shown in FIG. 1 as viewed from a first end face side.
Figure 3:
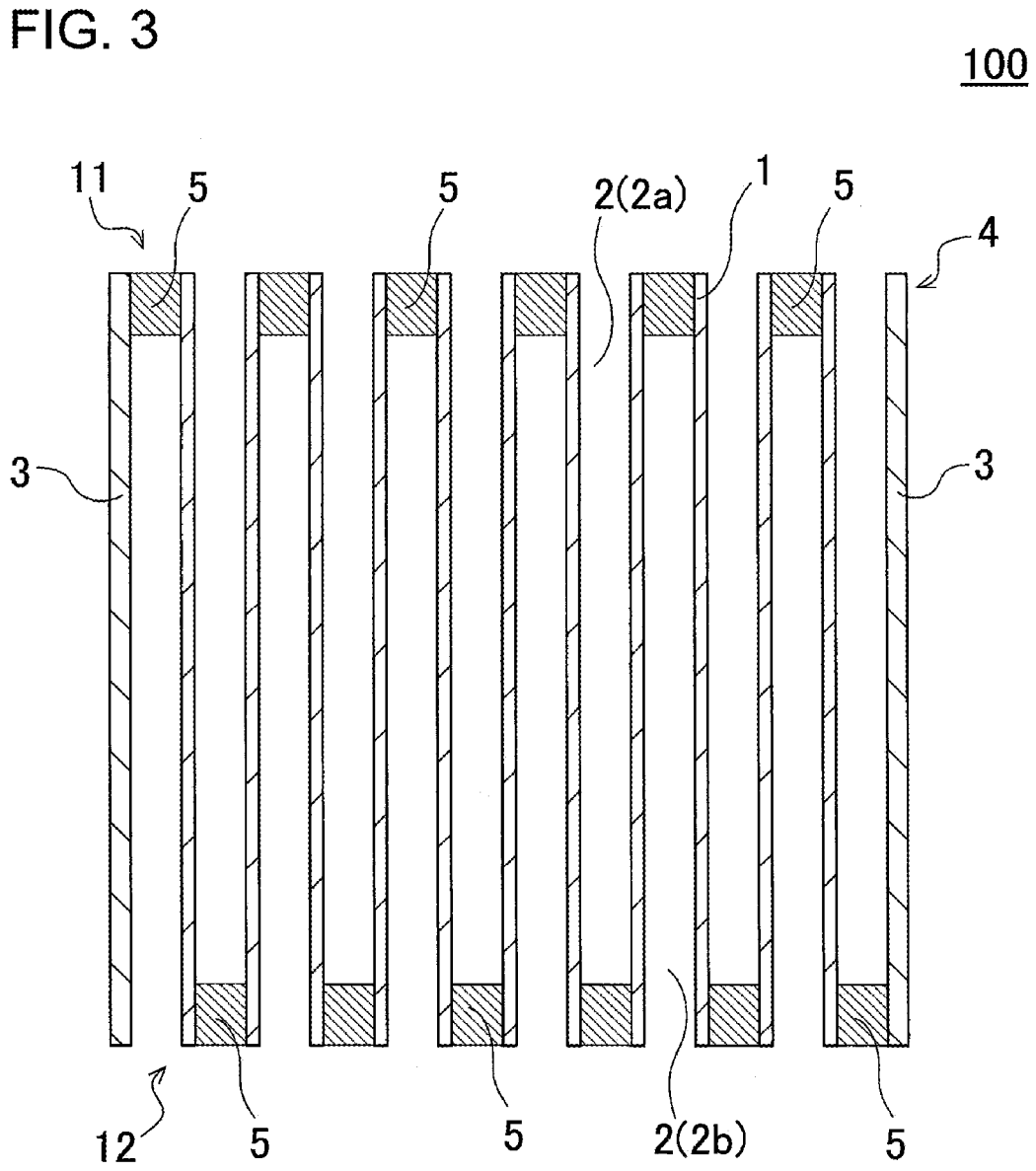
FIG. 3 is a sectional view schematically showing a section taken along the line A-A' of FIG. 2.

(1) Honeycomb Structure:

One embodiment of the honeycomb structure of the present invention is a honeycomb structure 100 including a pillar-shaped honeycomb structure body 4 with a porous partition wall 1, as shown in FIGS. 1 to 3. The honeycomb structure body 4 is of pillar-shaped having a porous partition wall 1 disposed so as to surround a plurality of cells 2 which serve as fluid through channels extending from a first end face 11 to a second end face 12. In the honeycomb structure 100, the honeycomb structure body 4 has a pillar shape, and further has a circumferential wall 3 on an outer peripheral side surface thereof. That is, the circumferential wall 3 is disposed so as to encompass the partition wall 1 arranged in a grid pattern.

FIG. 1 is a perspective view schematically showing an embodiment of the honeycomb structure of the present invention. FIG. 2 is a plan view of the honeycomb structure 100 shown in FIG. 1 as viewed from the first end face 11 side. FIG. 3 is a sectional view schematically showing a section taken along the line A-A' of FIG. 2.

The honeycomb structure 100 shown in FIGS. 1 to 3 further includes a plugging portion 5 disposed at an open end on the first end face 11 side or the second end face 12 side of each of the cells 2, and can be used as a filter for purifying exhaust gas.

The plugging portions 5 are disposed at open ends on the first end face 11 side or the second end face 12 side of each of the cells 2. In the honeycomb structure 100 shown in FIGS. 1 to 3, the plugging portions 5 are disposed at open ends on the first end face 11 side of the predetermined cells 2 and open ends on the second end face 12 side of the remaining cells 2, respectively. When the first end face 11 is an inflow end face and the second end face 12 is an outflow end face, the cell 2 in which the plugging portion 5 is disposed at an open end on the outflow end face side and the inflow end face side is opened is defined as an inflow cell 2*a*. Further, the cell 2 in which the plugging portion 5 is disposed at an open end on the inflow end face side and the outflow end face side is opened is defined as an outflow cell 2*b*. The inflow cells 2*a* and the outflow cells 2*b* are preferably disposed alternately with the partition wall 1 therebetween. Then, it is preferable that a checkerboard pattern is thereby formed by the plugging portions 5 and the "open ends of the cells 2" on both end faces of the honeycomb structure 100.

Figure 4:
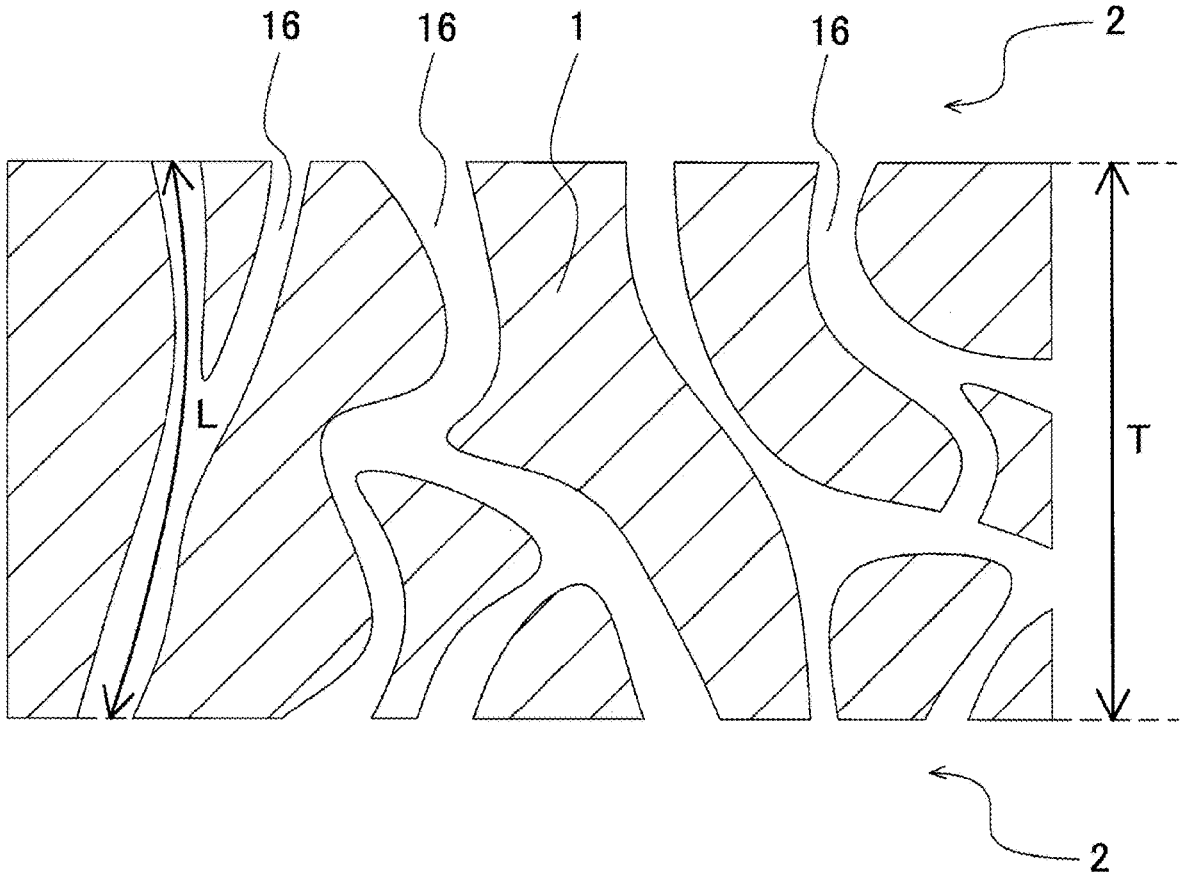
FIG. 4 is an enlarged section of the partition wall, and is a schematic diagram for explaining a through channel length of the pore formed in the porous body constituting the partition wall.

The honeycomb structure 100 has a particularly important configuration regarding the configuration of the partition wall 1 constituting the honeycomb structure body 4. First, in the honeycomb structure 100, the partition wall 1 constituting the honeycomb structure body 4 is formed by a porous body in which a plurality of pores 16 that communicate adjacent cells 2 separated by the partition wall 1 are formed, as shown in FIG. 4. FIG. 4 is an enlarged section of the partition wall 1, and is a schematic diagram for explaining a through channel length L of the pore 16 formed in the porous body constituting the partition wall 1.

As shown in FIG. 4, the two adjacent cells 2 are partitioned by the partition wall 1 formed by a porous body, and the thickness of the partition wall 1 partitioning the two adjacent cells 2 in this way is defined as the "thickness T (μm) of the partition wall 1". In addition, the through channel length of the pore 16 in the thickness direction of the partition wall 1 is defined as the "through channel length L (μm) of the pore 16". Then, a ratio (LIT) of the through channel length L (μm) of the pore 16 in the thickness direction of the partition wall 1 to the thickness T (μm) of the partition wall 1 is defined as a "bending degree A". Hereinafter, the bending degree A may be referred to as a "bending degree A of the pore 16".

The bending degree A of the pore 16 formed in the partition wall 1 is an index indicating the degree of bending of the pore 16 formed in the porous body constituting the partition wall 1. The pore 16 formed in the porous body constituting the partition wall 1 serves as a through channel for exhaust gas passing through the partition wall 1, and the degree of bending of the through channel can be indicated by the "bending degree A".

In the partition wall 1 constituting the honeycomb structure body 4, an average bending degree $A_{Ave}$, which is an average value of the bending degree A, is 1.10 to 1.40, and a value X ($X=A_{Ave}/B^2$) obtained by dividing the average bending degree $A_{Ave}$ by the square of a deviation bending degree B, which is a deviation of the bending degree A, is 100 to 300. With such a configuration, it is possible to effectively suppress an increase in pressure loss during deposition of PM such as soot when the honeycomb structure 100 is used as a filter for purifying exhaust gas. In particular, it is possible to extremely effectively suppress an increase in pressure loss during deposition of PM without requiring a special technique such as increasing porosity of the partition wall 1. That is, by setting the average bending degree $A_{Ave}$ within the above numerical range, the average bending degree $A_{Ave}$ becomes relatively small, the flow of the gas passing through the pore 16 in the partition wall 1 becomes more linear, and an increase in pressure loss during deposition of PM can be suppressed while maintaining the porosity of the partition wall 1. In addition, by setting the above-described value X obtained by dividing the average bending degree $A_{Ave}$ by the square of the deviation bending degree B within the above numerical range, the deviation of the bending degree A becomes small, that is, the variation of the bending degree A becomes small, and the ratio of the specific pores 16 in which the bending degree A is extremely large among the pores 16 in the partition wall 1 is reduced, so that the effect of suppressing an increase in pressure loss is more likely to be exhibited.

The average bending degree $A_{Ave}$ may be 1.10 to 1.40, preferably 1.10 to 1.35, and more preferably 1.10 to 1.30. For example, when the average bending degree $A_{Ave}$ is less than 1.10, the flow of the gas may become too linear, which is unfavorable since it may adversely affect the trapping performance of PM. On the other hand, when the average bending degree $A_{Ave}$ exceeds 1.40, it is difficult to obtain the effect of suppressing an increase in pressure loss during deposition of PM.

Further, the value X obtained by dividing the average bending degree $A_{Ave}$ by the square of the deviation bending degree B ($X=A_{Ave}/B^2$) may be 100 to 300, but is preferably 150 to 300, and more preferably 200 to 300. For example, when the value X is outside the above numerical range, it is difficult to obtain the effect of suppressing an increase in pressure loss during deposition of PM. When the value X is 150 to 300, it is preferable in that the variation of the pressure loss increase rate due to the deposition of PM can be suppressed to be small.

The bending degree A of the pore 16 and the average bending degree $A_{Ave}$, which is an average value of the bending degree A, can be measured in the following manner.

Specifically, first, the partition wall 1 of the honeycomb structure 100 is subjected to a CT scan to take a scanned image of the partition wall 1. As a CT scanning device, Xradia520Versa (trade name) manufactured by ZEISS is used. The measuring conditions are the tube voltage of 60 kV and the tube current of 0.083 mA. The resolution of the captured image is 1.2 μm/pixel.

The scanning direction of the CT scan is a direction along the thickness direction of the partition wall 1, and is a direction from the surface of the partition wall 1 (hereinafter, appropriately referred to as a partition wall surface) on the side of the cell 2 (for example, an inflow cell 2*a*) where a first end face 11, which is an upstream side end face of the honeycomb structure body 4, is opened toward the surface of the partition wall 1 (hereinafter, appropriately referred to as a partition wall back surface) on the side of the cell 2 (for example, an outflow cell 2*b*) where a second end face 12, which is a downstream side end face of the honeycomb structure body 4, is opened. Hereinafter, the scanning direction of the CT scan may be referred to as a "scanning direction S".

In the following explanation, an extending direction of the cells 2 of the honeycomb structure body 4 (in other words, a direction from the first end face 11 toward the second end face 12 of the honeycomb structure body 4) is defined as a Y direction. In addition, a direction perpendicular to the Y direction and along one of the four partition walls 1 surrounding the outflow cell 2*b* is defined as an X direction. A direction perpendicular to the X direction and the Y direction is defined as a Z direction. Therefore, the above-described scanning direction S can be referred to as a Z direction. For example, the scanned image of a Z direction is along an X-Y plane.

Next, a group of captured images in the scanning direction S are used for analysis. The group of captured images in the scanning direction S refers to a group of images captured in the scanning direction S, the number of which is equal to the number of captured image sheets, and is obtained by dividing the thickness (μm) of the partition wall 1 by 1.2 μm corresponding to 1 pixel. In the following examples, the analyzed image size is 500 μm×500 μm in the X and Y plane, and in the Z direction, the number of image sheets corresponding to the value obtained by dividing the thickness (μm) of the partition wall 1 by 1.2 μm are used.

Next, binarization process is performed on the captured image in the scanning direction S. The binarization is an operation for distinguishing between the void part in the partition wall 1 where the pore 16 is formed and the entity part of the partition wall 1. Since the brightness of the void part and the entity part of the partition wall 1 are different from each other, in the binarization process, noises remaining in the captured image are removed and an arbitrary threshold value is set, and then the binarization process is performed. Since the threshold value varies depending on each measurement sample, a threshold value capable of separating the void part and the entity part is set for each captured image by the mode method. The mode method is a method of finding a density boundary on the assumption that a binary image is composed of two parts: the "object" to be observed and the "background".

As described above, a three-dimensional model of the porous body constituting the partition wall 1 is obtained. That is, a three-dimensional porous body data (i.e., a three-dimensional model of the porous body) can be obtained by determining for each coordinate whether it is a space voxel or an object voxel by the binarization process described above.

Next, the obtained three-dimensional model of the porous body constituting the partition wall 1 is subjected to fluid analysis by the lattice Boltzmann method, and the obtained flow velocity results are used to calculate through channel lengths of the respective streamlines by determining the positions ($x^{n+1}$, $y^{n+1}$, $z^{n+1}$) [m, m, m] after Δt times [s] from the flow velocities at the flow velocities ($u^n$, $v^n$, $W^n$) [m/s, m/s, m/s] at the positions ($x^n$, $y^n$, $z^n$) [m, m, m] using the following formula. Here, the calculation example in which the unit of the position is [m] is shown, but the unit of the position may be set to [μm] as appropriate.

[Mathematical formula 1]

$$x^{(1)} = x^n$$

$$x^{(2)} = x^n + \Delta t a_{21} u^{(1)}$$

$$x^{(3)} = x^n + \Delta t\{a_{31} u^{(1)} + a_{32} u^{(2)}\}$$

$$x^{(4)} = x^n + \Delta t\{a_{41} u^{(1)} + a_{42} u^{(2)} + a_{43} u^{(3)}\}$$

$$x^{n+1} = x^n + \Delta t\{b_1 u^{(1)} + b_2 u^{(2)} + b_3 u^{(3)} + b_4 u^{(4)}\}$$

The value obtained by dividing the calculated through channel length of each streamline by the thickness of the partition wall 1 is the bending degree A of each streamline, and the average value of each bending degree A is taken as the average bending degree $A_{Ave}$.

The deviation bending degree B, which is the deviation of the bending degree A, can be calculated by taking the root (√) of the root mean square of each deviation.

The thickness T of the partition wall 1 is not particularly limited, but is preferably 100 to 300 μm, more preferably 125 to 275 μm, and particularly preferably 150 to 250 μm, for example. The thickness of the partition wall 1 can be measured with a scanning electron microscope or a microscope, for example. If the thickness of the partition wall 1 is too thin, it is not preferable in that the trapping performance is deteriorated. On the other hand, if the thickness of the partition wall 1 is too thick, it is not preferable in that pressure loss increases.

The porosity of the partition wall 1 is not particularly limited, but is preferably 35 to 70%, more preferably 35 to 65%, and particularly preferably 35 to 60%, for example. With this configuration, the honeycomb structure 100 can be suitably used as a filter for purifying exhaust gas emitted from an automobile engine. The porosity of the partition wall 1 is a value measured by mercury press-in method. The porosity of the partition wall 1 can be measured using, for example, Autopore 9500 (trade name) manufactured by Micromeritics. To measure the porosity, a part of the partition wall 1 is cut out from the honeycomb structure body 4 to obtain a sample piece, and the sample piece thus obtained can be used.

The average pore diameter of the partition wall 1 is not particularly limited, but is preferably 8 to 30 μm, and more preferably 8 to 25 μm. The average pore diameter of the partition wall 1 is a value measured by a mercury press-in method. The average pore diameter of the partition wall 1 can be measured, for example, using Autopore 9500 (trade name) manufactured by Micromeritics in the same manner as the measurement of the porosity.

The cell density of the cell 2 defined by the partition wall 1 is preferably 30 to 65 cells/cm$^2$, more preferably 40 to 55 cells/cm$^2$, for example. With this configuration, the honeycomb structure 100 can be suitably used as a filter for purifying exhaust gas emitted from an automobile engine.

The shape of the cells 2 formed in the honeycomb structure body 4 is not particularly limited. For example, the shape of the cells 2 in a section orthogonal to the extending direction of the cell 2 may be polygonal, circular, elliptical or the like. Examples of the polygonal shape include a triangle, a quadrangle, a pentagon, a hexagon, and an octagon. The shape of the cell 2 is preferably a triangle, a quadrangle, a pentagon, a hexagon, or an octagon. In the present invention, the cell 2 means a space surrounded by the partition wall 1.

Regarding the shape of the cells 2 formed in the honeycomb structure body 4, all the cells 2 may be the same shape or may be different shapes. For example, although not shown, quadrangular cells and octagonal cells may be combined. For example, the shape of the outflow cells may be different from the shape of the inflow cells in a section orthogonal to the extending direction of the cells of the honeycomb structure body. In such an embodiment, for example, it is preferable that the outflow cells have one of a quadrangular and an octagonal shape, and the inflow cells have the other of a quadrangular and an octagonal shape.

Regarding the size of the cells 2 formed in the honeycomb structure body 4, all the cells 2 may be the same size or may be different sizes. For example, although not shown, some of the plurality of cells may be larger, and other cells may be smaller relatively.

The circumferential wall 3 of the honeycomb structure body 4 may be configured integrally with the partition wall 1 or may be a circumferential coat layer formed by applying a circumferential coating material on the circumferential side of the partition wall 1. For example, although not shown, the circumferential coat layer can be provided on the circumferential side of the partition wall after the partition wall and the circumferential wall are integrally formed and then the formed circumferential wall is removed by a publicly known method, such as grinding, in a manufacturing process.

The shape of the honeycomb structure body 4 is not particularly limited. The honeycomb structure body 4 may be a pillar-shape in which the shapes of the first end face 11 (e.g., the inflow end face) and the second end face 12 (e.g., the outflow end face) are circular, elliptical, polygonal, or the like.

The size of the honeycomb structure body 4, for example, the length from the first end face 11 to the second end face 12, and the size of the section that is orthogonal to the extending direction of the cells 2 of the honeycomb structure body 4 are not particularly limited. Each size may be selected as appropriate such that optimum purification performance is obtained when the honeycomb structure 100 is used as a filter for purifying exhaust gas.

The material of the partition wall 1 is not particularly limited, and may be any material as long as the above-described average bending degree $A_{Ave}$ and value X obtained by dividing the average bending degree $A_{Ave}$ by the square of the deviation bending degree B satisfy the above numerical range. For example, the material of the partition wall 1 preferably contains at least one selected from the group consisting of silicon carbide, cordierite, silicon-silicon carbide composite material, cordierite-silicon carbide composite material, silicon nitride, mullite, alumina, and aluminium titanate. The material constituting the partition wall 1 is preferably a material containing 90% by mass or more of these materials listed in the above group, more preferably a material containing 92% by mass or more, and particularly preferably a material containing 95% by mass or more. The silicon-silicon carbide composite material is a composite material formed using silicon carbide as an aggregate and silicon as a bonding material. The cordierite-silicon carbide composite material is a composite material formed using silicon carbide as an aggregate and cordierite as a bonding material. As the material of the partition wall 1, cordierite and silicon-silicon carbide composite material are particularly preferable materials among the materials described above.

The material of the plugging portion 5 is preferably a material that is preferred as the material of the partition wall 1. The material of the plugging portions 5 and the material of the partition wall 1 may be the same or different.

(2) Manufacturing Method of Honeycomb Structure

Next, a manufacturing method of the honeycomb structure of the present embodiment will be described. The honeycomb structure of the present embodiment can be manufactured, for example, by the following methods. Firstly, a plastic kneaded material for making a honeycomb structure body is prepared. The kneaded material for making a honeycomb structure body can be prepared, for example, as follows.

A material selected from the above-described group of preferable materials for the partition wall is used as a raw material powder, and additives such as a binder, a pore former, and water can be appropriately added to prepare. Incidentally, by adjusting the particle size of the silicon carbide to be an aggregate in the raw material powders to be used, it is possible to change the "bending degree A" of the partition wall in the honeycomb structure of the present embodiment as described above. For example, although not particularly limited, the finer the silicon carbide to be an aggregate, the more uniform the microstructure becomes, and the smaller the bending degree A tends to be.

Next, the kneaded material thus obtained is subjected to extrusion so as to make a honeycomb formed body having a partition wall defining a plurality of cells and an outer wall disposed so as to encompass the partition wall.

The obtained honeycomb formed body is dried, for example, by microwave and hot air. Next, if required, an open end of the cell is plugged with a material similar to the material used for making the honeycomb formed body to provide a plugging portion. After forming the plugging portion, the honeycomb formed body may be dried again.

Next, a honeycomb formed body or a honeycomb formed body in which the plugging portions have been formed is fired to manufacture a honeycomb structure. The firing temperature and the firing atmosphere differ according to the raw material, and those skilled in the art can select the firing temperature and the firing atmosphere that are the most suitable for the selected material.

The honeycomb structure of the present embodiment can be manufactured by the above-described manufacturing method.

EXAMPLES

The following will describe the present invention more specifically by examples, but the present invention is not at all limited by these examples.

Example 1

Talc, kaolin, alumina, aluminium hydroxide, silica, and the like were prepared as a forming raw material for preparing a kneaded material. In Example 1, each of the raw materials described above were blended to prepare a cordierite forming raw material.

Next, a kneaded material was prepared by adding 2.0 parts by mass of a water-absorbing polymer as a pore former, 6 parts by mass of a binder, 1.0 parts by mass of a surfactant, and 70 parts by mass of water to 100 parts by mass of the forming raw material. As the water-absorbing polymer as a pore former, a polymer having a particle diameter of 10 μm was used. As the binder, methylcellulose was used. As the dispersing agent, potassium laurate soap was used.

Next, the obtained kneaded material was molded using an extruder to make a honeycomb formed body. Next, the obtained honeycomb formed body was dried by high frequency dielectric heating, and then further dried using a hot air dryer. The shape of the cells in the honeycomb formed body was quadrangular.

Next, a plugging portion was formed on the dried honeycomb formed body. First, the inflow end face of the honeycomb formed body was masked. Next, the end portion provided with a mask (the end portion on the inflow end face side) was immersed in a plugging slurry, and the plugging slurry was filled into an open end of the cell without the mask (the outflow cell). In this way, a plugging portion was formed on the inflow end face side of the honeycomb formed body. Then, the plugging portion was also formed in the inflow cell in the same manner for the outflow end face of the dried honeycomb formed body.

Next, the honeycomb formed body on which the plugging portions have been formed was dried in a microwave dryer and completely dried with a hot air dryer, and then both end faces of the honeycomb formed body were cut and adjusted to a predetermined size. The dried honeycomb formed body was then degreased and fired to manufacture a honeycomb structure of Example 1.

The honeycomb structure of Example 1 had a diameter of the end face of 266.7 mm and a length in the extending direction of the cell of 254.0 mm. The thickness T of the partition wall was 156 μm and the cell density was 47 cells/cm$^2$. The values of the thickness T of the partition wall are shown in Table 1.

For the honeycomb structure of Example 1, the porosity and the average pore diameter of the partition wall were measured. Table 1 shows the results. The porosity and the average pore diameter of the partition wall were measured using Autopore 9500 (trade name) manufactured by Micromeritics.

In addition, for the honeycomb structure of Example 1, the average bending degree $A_{Ave}$ and the deviation bending degree B were determined by the methods described so far. Then, a value X ($X=A_{Ave}/B^2$) obtained by dividing the average bending degree $A_{Ave}$ by the square of the deviation bending degree B was calculated. The values are shown in Table 1.

TABLE 1

| | Configuration of Partition wall | | | | | | | After PM deposition | | |
|---|---|---|---|---|---|---|---|---|---|---|
| | | | Pore | | | | Initial | | Pressure | Pressure loss |
| | Thickness T (μm) | Porosity (%) | Average pore diameter (μm) | Average bending degree $A_{Ave}$ | Deviation bending degree B | Value X ($A_{ave}/B^2$) | pressure loss value $P_0$ (Pa) | Pressure loss value $P_1$ (Pa) | loss increase ΔP (Pa) | increase rate ($\Delta P/P_0$) (%) |
| Example 1 | 156 | 49.8 | 9.6 | 1.29 | 0.089 | 163 | 47.9 | 116.9 | 68.9 | 144 |
| Example 2 | 155 | 49.5 | 9.5 | 1.32 | 0.104 | 122 | 50.2 | 119.6 | 69.4 | 138 |
| Example 3 | 157 | 53.3 | 12.0 | 1.30 | 0.104 | 121 | 21.5 | 96.5 | 75.0 | 349 |
| Comparative Example 1 | 135 | 47.7 | 21.7 | 1.26 | 0.156 | 52 | 5.5 | 90.1 | 84.7 | 1552 |
| Comparative Example 2 | 104 | 58.7 | 27.2 | 1.24 | 0.175 | 40 | 3.3 | 85.0 | 81.7 | 2470 |
| Comparative Example 3 | 95 | 62.0 | 34.7 | 1.32 | 0.222 | 27 | 2.9 | 100.7 | 97.7 | 3330 |
| Comparative Example 4 | 96 | 56.5 | 21.9 | 1.35 | 0.229 | 26 | 6.0 | 93.1 | 87.1 | 1454 |
| Comparative Example 5 | 151 | 62.5 | 21.8 | 1.24 | 0.115 | 94 | 5.2 | 66.5 | 61.3 | 1176 |

For the honeycomb structure of Example 1, the "initial pressure loss value $P_0$ (Pa)" and the "pressure loss value $P_1$ (Pa) after PM deposition", the "pressure loss increase ΔP (Pa)" and the "pressure loss increase rate (%)" after PM deposition due to the deposition of PM were determined in the following manner. Table 1 shows the results.

[Initial Pressure Loss Value $P_0$ (Pa)]

The fluid analysis was performed using the lattice Boltzmann method, in which the center of each voxel of the three-dimensional data of the porous body was set as each lattice point, and a predetermined relational equation was used regarding the fluid flow between each lattice point and its adjacent lattice point when the fluid flows in from the inflow end face. The differential pressure between the inflow end face and the outflow end face was calculated as the initial pressure loss value $P_0$ (Pa).

[Pressure Loss Value $P_1$ (Pa) after PM Deposition]

Based on the results of the fluid analysis, a flow velocity vector consisting of a flow velocity and a flow direction was derived for each spatial voxel of the three-dimensional data of the porous body as the information regarding the fluid flow for each spatial voxel. Next, the motion of PM was predicted by simulating a condition in which PM (soot) is placed on the fluid flow represented by the flow velocity vector. At this time, it is assumed that PM approaching an object voxel is trapped to the object voxel. When PM was deposited in about 1% of the pore volume, the fluid analysis was performed again to determine the pressure loss value $P_1$ ($P_a$) after PM deposition.

[Pressure Loss Increase ΔP (Pa) after PM Deposition]

The difference between the initial pressure loss value $P_0$ (Pa) and the pressure loss value $P_1$ (Pa) after PM deposition determined by the above-described method (i.e., $P_1-P_0$) was defined as the pressure loss increase ΔP (Pa) after PM deposition.

[Pressure Loss Increase Rate (%) after PM Deposition Due to PM Deposition]

The increasing ratio of the pressure loss after PM deposition to the initial pressure loss value $P_0$ (Pa) (i.e., $\Delta P/P_0 \times 100\%$) was defined as a pressure loss increase rate (%) after PM deposition due to PM deposition. A pressure loss increase rate (%) of 350% or less was considered to be acceptable.

Examples 2 to 8 and Comparative Examples 1 to 13

In Examples 2 to 8 and Comparative Examples 1 to 13, the kneaded materials were prepared by changing raw materials used for the cordierite forming raw material as shown below. The average particle diameter of the water-absorbing polymer and the like in the raw material, the blending ratio, and the amount of water to be added were changed. The kneaded material was prepared in the same manner as in Example 1, except that the kneaded material was prepared using these raw materials, and the honeycomb structures having configurations of the partition wall as shown in Tables 1 to 3 were prepared.

The honeycomb structures of Examples 2 to 8 and Comparative Examples 1 to 13 were also measured for the porosity and the average pore diameter of the partition wall in the same manner as in Example 1. The results are shown in Tables 1 to 3. In addition, for the honeycomb structures of Examples 2 to 8 and Comparative Examples 1 to 13, the "initial pressure loss value $P_0$ (Pa)", the "pressure loss value $P_1$ (Pa) after PM deposition", and the "pressure loss increase ΔP (Pa)" and the "pressure loss increase rate (%)" after PM deposition due to PM deposition were determined in the same manner as in Example 1. The results are shown in Tables 1 to 3.

TABLE 2

| | Configuration of Partition wall | | | | | | Initial | After PM deposition | | |
|---|---|---|---|---|---|---|---|---|---|---|
| | | | Pore | | | | | | | |
| | Thickness T (μm) | Porosity (%) | Average pore diameter (μm) | Average bending degree $A_{Ave}$ | Deviation bending degree B | Value X ($A_{ave}/B^2$) | pressure loss value $P_0$ (Pa) | Pressure loss value $P_1$ (Pa) | Pressure loss increase ΔP (Pa) | Pressure loss increase rate ($\Delta P/P_0$) (%) |
| Comparative Example 6 | 203 | 59.4 | 41.9 | 1.37 | 0.172 | 46 | 3.3 | 101.6 | 98.3 | 2990 |
| Comparative Example 7 | 213 | 56.1 | 16.0 | 1.32 | 0.164 | 49 | 12.7 | 114.2 | 101.5 | 800 |
| Comparative Example 8 | 267 | 62.7 | 24.8 | 1.35 | 0.149 | 61 | 8.3 | 99.1 | 90.7 | 1089 |
| Example 4 | 172 | 52.4 | 8.8 | 1.24 | 0.066 | 289 | 48.5 | 111.1 | 62.6 | 129 |
| Example 5 | 205 | 53.8 | 13.3 | 1.23 | 0.068 | 265 | 21.7 | 91.8 | 70.1 | 322 |
| Comparative Example 9 | 232 | 61.7 | 20.0 | 1.30 | 0.114 | 99 | 10.7 | 81.7 | 71.0 | 664 |

TABLE 3

| | Configuration of Partition wall | | | | | | Initial | After PM deposition | | |
|---|---|---|---|---|---|---|---|---|---|---|
| | | | Pore | | | | | | | |
| | Thickness T (μm) | Porosity (%) | Average pore diameter (μm) | Average bending degree $A_{Ave}$ | Deviation bending degree B | Value X ($A_{ave}/B^2$) | pressure loss value $P_0$ (Pa) | Pressure loss value $P_1$ (Pa) | Pressure loss increase ΔP (Pa) | Pressure loss increase rate ($\Delta P/P_0$) (%) |
| Comparative Example 10 | 246 | 63.5 | 23.7 | 1.27 | 0.136 | 69 | 6.4 | 86.7 | 80.3 | 1252 |
| Comparative Example 11 | 278 | 64.2 | 25.6 | 1.37 | 0.151 | 60 | 9.5 | 97.7 | 88.2 | 925 |
| Example 6 | 251 | 49.1 | 11.0 | 1.28 | 0.068 | 280 | 53.2 | 148.1 | 94.9 | 179 |
| Comparative Example 12 | 259 | 62.1 | 23.5 | 1.33 | 0.131 | 78 | 12.5 | 101.7 | 89.2 | 713 |
| Comparative Example 13 | 235 | 47.8 | 17.0 | 1.28 | 0.117 | 94 | 26.7 | 142.4 | 115.7 | 433 |
| Example 7 | 258 | 48.3 | 11.0 | 1.28 | 0.070 | 257 | 56.6 | 145.7 | 89.2 | 158 |
| Example 8 | 262 | 53.1 | 12.8 | 1.25 | 0.071 | 250 | 31.0 | 117.2 | 86.2 | 278 |

Example 9

As a forming raw material for preparing the kneaded material, a powder obtained by mixing silicon carbide (SiC) powder and metallic silicon (Si) powder was prepared. Next, 9 parts by mass of a water-absorbing polymer and a starch as a pore former, 1.0 parts by mass of a binder, 2.0 parts by mass of an auxiliary agent, and 35 parts by mass of water were added to 100 parts by mass of the forming raw material to prepare a kneaded material. As the water-absorbing polymer as a pore former, a polymer having a particle diameter of 10 μm was used. As the starch as a pore former, starch having a particle diameter of 6 μm was used. As the binder, hydroxypropylmethylcellulose and montmorillonite were used. As the auxiliary agent, strontium carbonate and aluminum hydroxide were used.

Next, using the obtained kneaded material, a honeycomb structure of Example 9 having a configuration of the partition wall as shown in Table 4 was prepared in the same manner as in Example 1.

Examples 10 to 22 and Comparative Examples 14 to 29

In Examples 10 to 22 and Comparative Examples 14 to 29, the kneaded materials were prepared by changing raw materials for preparing the kneaded material as shown below. The average particle diameter of the pore former and the like in the raw material, the blending ratio, and the amount of water to be added were changed. The kneaded material was prepared in the same manner as in Example 11, except that the kneaded material was prepared using these raw materials, and the honeycomb structures having configurations of the partition wall as shown in Tables 4 to 7 were prepared.

The honeycomb structures of Examples 9 to 22 and Comparative Examples 14 to 29 were also measured for the porosity and the average pore diameter of the partition wall in the same manner as in Example 1. The results are shown in Tables 4 to 7. In addition, for the honeycomb structures of Examples 9 to 22 and Comparative Examples 14 to 29, the "initial pressure loss value $P_0$ (Pa)", the "pressure loss value $P_1$ (Pa) after PM deposition", and the "pressure loss increase ΔP (Pa)" and the "pressure loss increase rate (%)" after PM deposition due to PM deposition were determined in the same manner as in Example 1. The results are shown in Tables 4 to 7.

TABLE 4

| | Configuration of Partition wall | | | | | | Initial | After PM deposition | | |
|---|---|---|---|---|---|---|---|---|---|---|
| | | | Pore | | | | | | | Pressure |
| | Thickness T (μm) | Porosity (%) | Average pore diameter (μm) | Average bending degree $A_{Ave}$ | Deviation bending degree B | Value X ($A_{ave}/B^2$) | pressure loss value $P_0$ (Pa) | Pressure loss value $P_1$ (Pa) | Pressure loss increase ΔP (Pa) | loss increase rate ($\Delta P/P_0$) (%) |
| Example 9 | 224 | 39.4 | 14.4 | 1.30 | 0.096 | 142 | 36.4 | 135.4 | 99.0 | 272 |
| Example 10 | 228 | 39.6 | 14.5 | 1.34 | 0.102 | 129 | 38.3 | 147.5 | 109.1 | 285 |
| Example 11 | 228 | 37.9 | 15.7 | 1.33 | 0.114 | 103 | 35.5 | 140.4 | 104.9 | 295 |
| Comparative Example 14 | 225 | 38.0 | 17.9 | 1.42 | 0.134 | 79 | 29.7 | 172.2 | 142.4 | 479 |
| Comparative Example 15 | 225 | 39.2 | 18.7 | 1.42 | 0.161 | 55 | 28.5 | 188.6 | 160.0 | 561 |
| Comparative Example 16 | 229 | 32.7 | 19.4 | 1.38 | 0.194 | 37 | 29.6 | 223.5 | 193.9 | 654 |

TABLE 5

| | Configuration of Partition wall | | | | | | Initial | After PM deposition | | |
|---|---|---|---|---|---|---|---|---|---|---|
| | | | Pore | | | | | | | Pressure |
| | Thickness T (μm) | Porosity (%) | Average pore diameter (μm) | Average bending degree $A_{Ave}$ | Deviation bending degree B | Value X ($A_{ave}/B^2$) | pressure loss value $P_0$ (Pa) | Pressure loss value $P_1$ (Pa) | Pressure loss increase ΔP (Pa) | loss increase rate ($\Delta P/P_0$) (%) |
| Example 12 | 230 | 45.3 | 14.0 | 1.31 | 0.087 | 175 | 32.0 | 139.2 | 107.2 | 335 |
| Comparative Example 17 | 214 | 44.2 | 16.2 | 1.36 | 0.117 | 99 | 27.0 | 135.9 | 108.9 | 403 |
| Comparative Example 18 | 218 | 45.8 | 17.7 | 1.36 | 0.117 | 99 | 21.6 | 130.2 | 108.6 | 502 |
| Comparative Example 19 | 219 | 45.8 | 16.7 | 1.37 | 0.130 | 82 | 25.4 | 128.1 | 102.7 | 404 |
| Comparative Example 20 | 217 | 40.9 | 19.0 | 1.31 | 0.129 | 79 | 18.7 | 136.3 | 117.6 | 629 |

TABLE 5-continued

| | Configuration of Partition wall | | | | | | Initial | After PM deposition | | |
|---|---|---|---|---|---|---|---|---|---|---|
| | | | Pore | | | | | | | |
| | Thickness T (μm) | Porosity (%) | Average pore diameter (μm) | Average bending degree $A_{Ave}$ | Deviation bending degree B | Value X ($A_{ave}/B^2$) | pressure loss value $P_0$ (Pa) | Pressure loss value $P_1$ (Pa) | Pressure loss increase ΔP (Pa) | Pressure loss increase rate ($\Delta P/P_0$) (%) |
| Comparative Example 21 | 224 | 40.5 | 19.5 | 1.42 | 0.166 | 52 | 26.9 | 152.1 | 125.2 | 465 |
| Comparative Example 22 | 214 | 43.6 | 20.2 | 1.41 | 0.161 | 54 | 18.1 | 137.9 | 119.8 | 662 |

TABLE 6

| | Configuration of Partition wall | | | | | | Initial | After PM deposition | | |
|---|---|---|---|---|---|---|---|---|---|---|
| | | | Pore | | | | | | | |
| | Thickness T (μm) | Porosity (%) | Average pore diameter (μm) | Average bending degree $A_{Ave}$ | Deviation bending degree B | Value X ($A_{ave}/B^2$) | pressure loss value $P_0$ (Pa) | Pressure loss value $P_1$ (Pa) | Pressure loss increase ΔP (Pa) | Pressure loss increase rate ($\Delta P/P_0$) (%) |
| Example 13 | 235 | 38.5 | 12.7 | 1.30 | 0.088 | 166 | 51.3 | 165.0 | 113.7 | 222 |
| Example 14 | 248 | 36.9 | 13.0 | 1.39 | 0.106 | 124 | 67.9 | 212.9 | 145.1 | 214 |
| Example 15 | 235 | 40.0 | 14.7 | 1.29 | 0.103 | 122 | 34.3 | 137.3 | 103.0 | 300 |
| Comparative Example 23 | 235 | 39.6 | 20.3 | 1.42 | 0.154 | 60 | 23.9 | 155.8 | 131.9 | 551 |
| Comparative Example 24 | 235 | 31.8 | 16.9 | 1.50 | 0.194 | 40 | 69.8 | 327.0 | 257.1 | 368 |
| Example 16 | 250 | 34.7 | 12.4 | 1.39 | 0.118 | 100 | 83.4 | 231.0 | 147.6 | 177 |
| Comparative Example 25 | 241 | 37.0 | 15.3 | 1.37 | 0.119 | 97 | 44.2 | 207.2 | 163.0 | 368 |
| Example 17 | 238 | 39.3 | 13.5 | 1.40 | 0.117 | 102 | 50.2 | 194.9 | 144.8 | 288 |
| Comparative Example 26 | 245 | 34.7 | 15.6 | 1.43 | 0.154 | 60 | 57.8 | 271.1 | 213.4 | 369 |

TABLE 7

| | Configuration of Partition wall | | | | | | Initial | After PM deposition | | |
|---|---|---|---|---|---|---|---|---|---|---|
| | | | Pore | | | | | | | |
| | Thickness T (μm) | Porosity (%) | Average pore diameter (μm) | Average bending degree $A_{Ave}$ | Deviation bending degree B | Value X ($A_{ave}/B^2$) | pressure loss value $P_0$ (Pa) | Pressure loss value $P_1$ (Pa) | Pressure loss increase ΔP (Pa) | Pressure loss increase rate ($\Delta P/P_0$) (%) |
| Example 18 | 246 | 43.6 | 12.2 | 1.30 | 0.074 | 238 | 47.2 | 132.1 | 85.0 | 180 |
| Comparative Example 27 | 236 | 40.5 | 21.5 | 1.35 | 0.141 | 68 | 19.0 | 154.1 | 135.1 | 713 |
| Example 19 | 241 | 40.2 | 12.4 | 1.40 | 0.116 | 104 | 57.8 | 164.4 | 106.6 | 184 |
| Comparative Example 28 | 237 | 40.8 | 20.8 | 1.38 | 0.137 | 73 | 20.1 | 147.5 | 127.4 | 634 |
| Example 20 | 250 | 44.2 | 13.2 | 1.33 | 0.093 | 153 | 44.6 | 138.1 | 93.5 | 210 |
| Example 21 | 238 | 43.7 | 14.6 | 1.30 | 0.092 | 152 | 33.0 | 130.2 | 97.2 | 295 |
| Comparative Example 29 | 237 | 48.1 | 18.3 | 1.34 | 0.120 | 94 | 19.9 | 118.4 | 98.5 | 495 |
| Example 22 | 243 | 44.8 | 12.2 | 1.29 | 0.080 | 202 | 43.8 | 137.8 | 94.0 | 215 |

(Results)

As shown in Tables 1, the honeycomb structures of Examples 1 to 3 were able to suppress the increase in pressure loss during deposition of PM compared to the honeycomb structures of Comparative Examples 1 to 5. In Table 1, a honeycomb structure in which the thickness T (μm) of the partition wall falls within a certain range is used as a comparison target.

Similarly, in Tables 2 to 7, the honeycomb structures of Examples in the respective tables were able to suppress the increase in pressure loss during deposition of PM compared to the honeycomb structures of Comparative Examples in the respective tables. In Tables 2 to 7, a honeycomb structure in which at least one of the thickness T (μm) and the porosity (%) of the partition wall falls within a certain range is used as a comparison target. In addition, among the honeycomb structures of Examples, in particular, the honeycomb structure having a value X of 150 to 300 was found to be able to suppress variation of the pressure loss increase rate (%) due to deposition of PM to be small.

INDUSTRIAL APPLICABILITY

The honeycomb structure of the present invention can be used as a trapping filter for removing particulates and the like contained in exhaust gas.

DESCRIPTION OF REFERENCE NUMERALS

1: partition wall, 2: cell, 2*a*: inflow cell, 2*b*: outflow cell, 3: circumferential wall, 4: honeycomb structure body, 5: plugging portion, 11: first end face, 12: second end face, 16: pore, 100: honeycomb structure.

What is claimed is:

1. A honeycomb structure comprising a pillar-shaped honeycomb structure body having a partition wall arranged so as to surround a plurality of cells which serve as fluid through channels extending from a first end face to a second end face, wherein the partition wall is formed by a porous body in which a plurality of pores that communicate with adjacent cells of the plurality of cells separated by the partition wall are formed, a ratio (L/T) of a through channel length L (μm) of a pore of the plurality of pores in a thickness direction of the partition wall to a thickness T (μm) of the partition wall is defined as a bending degree A, the partition wall constituting the honeycomb structure body has an average bending degree $A_{Ave}$, which is an average value of the bending degree A, of 1.10 to 1.40, and a value X ($X=A_{Ave}/B^2$) obtained by dividing the average bending degree $A_{Ave}$ by a square of a deviation bending degree B, which is a deviation of the bending degree A, is 100 to 300.

2. The honeycomb structure according to claim 1, further comprising a plugging portion disposed at an open end on the first end face-side or the second end face of each cell of the plurality of cells.

3. The honeycomb structure according to claim 1, wherein the thickness T of the partition wall is 100 to 300 μm.

4. The honeycomb structure according to claim 1, wherein a porosity of the partition wall is 35 to 70%.

5. The honeycomb structure according to claim 1, wherein an average pore diameter of the partition wall is 8 to 30 μm.

6. The honeycomb structure of claim 1, wherein the value X is 150 to 300.

* * * * *